US006676670B1

(12) United States Patent
Dolev

(10) Patent No.: US 6,676,670 B1
(45) Date of Patent: Jan. 13, 2004

(54) HAIR DEPILATING DEVICE WITH IMPROVED PLUCKING EFFICIENCY

(76) Inventor: Moshe Dolev, 4 Hamelacha Street, Industrial Zone, Ra'nana (IL), 43100

( * ) Notice: Subject to any disclaimer, the term of this patent is extended or adjusted under 35 U.S.C. 154(b) by 0 days.

(21) Appl. No.: 10/223,718

(22) Filed: Aug. 20, 2002

(51) Int. Cl.[7] ..... A61B 17/50
(52) U.S. Cl. ..... 606/133
(58) Field of Search ..... 606/131, 133; 30/32–84, 123.3

(56) References Cited

U.S. PATENT DOCUMENTS 5,281,233 A * 1/1994 Dolev ..... 606/133
5,916,222 A * 6/1999 Iwasaki et al. ..... 606/133
6,176,862 B1 * 1/2001 Delay et al. ..... 606/133
6,451,028 B1 * 9/2002 Sanchez-Martinez et al. .... 606/133

* cited by examiner

*Primary Examiner*—Michael J. Milano
*Assistant Examiner*—(Jackie)Tan-Uyen T. Ho
(74) *Attorney, Agent, or Firm*—Edward Langer; Shiboleth, Yisraeli, Roberts, Zisman & Co.

(57) ABSTRACT

A hair depilating device having a plucking assembly comprising at least two hubs, each accomodating at least one radially-extending swivel element mounted on the hub via a pin radially extending from the wall of the hub. The sidewall of the hub further includes a pinch plate, which projects radially outwardly therefrom. The radially-extending swivel element and pinch plate of a neighboring disc-like assembly define a V-shaped hair trap. The other side of the pinch plate forms a second V-shaped hair trap with a radial extension swivel element of a third opposing neighboring disc-like assembly. The opposing edges of the hair-traps at the rear end meet first, and only afterwards is the entire trap closed. This design provides a substantially reduced rotational closure distance, traveled by the hair-trap elements from the instant the trap begins to close until full trap closure. The trap closing displacement required for closure is also greatly reduced and more hairs are trapped and the plucking efficiency increased.

10 Claims, 11 Drawing Sheets

HAIR DEPILATING DEVICE WITH IMPROVED PLUCKING EFFICIENCY

FIELD OF THE INVENTION

The present invention relates to a hand held, motorized depilating device for removing unwanted skin hair, and more particularly, for plucking out skin hair, utilizing a new method to shorten hair-trap closure distance, thereby increasing the hair plucking efficiency.

BACKGROUND OF THE INVENTION

Substantially all the depilating devices currently on the market operate in a very similar manner. Their operation is based on a rotating hair plucking assembly having a collection of tweezer elements mounted thereon. Hair traps, formed by the interaction between the aforementioned tweezer elements, are opened and closed by either employing a system of cams or by employing inclined thrust bearings. The first of these types is shown in the devices based on U.S. Pat. No. 5,112,341 to Dolev, the present inventor. The second of these types is shown in the devices based on U.S. Pat. No. 5,281,233 to Dolev. Another common feature is that in these depilating devices, opposing edges of the hair-trap tweezer elements remain parallel to one another, during the entire period of hair-trap opening and closing.

Opening and closing the aforementioned hair traps by employing a system of inclined thrust bearings is quiet, efficient and essentially devoid of excess vibrations. However, the rotational closure distance, traveled by the hair-trap elements from the instant the trap begins to close until full trap closure, is quite long. Consequently, a large percentage of the hairs that entered the trap at an early stage of closure succeed in escaping the trap before closure is complete. In addition, another substantial percentage of hairs is unable to enter the trap during the later stages of closure, as the entry gap to the trap has been substantially reduced at these stages.

It is possible to reduce the rotational closure distance, traveled by the hair-trap elements from the instant the trap begins to close until full trap closure, by employing cams to convey the closing force. However, use of the cam mechanism increases the energy expenditure, the noise level, the vibrations, and the resulting level of discomfort encountered in using the device.

Therefore, it would be desirable to provide a superior power-driven depilating device, which provides a reduction in the rotational closure distance, traveled by the hair-trap elements from the instant the trap begins to close until full trap closure. In addition, it would be desirable to simultaneously increase the hair plucking efficiency, without increasing the energy expenditure, the noise level, the vibrations, and the resulting level of discomfort encountered in using the device.

SUMMARY OF THE INVENTION

Accordingly, it is a principal object of the present invention to overcome the above-mentioned disadvantages and provide a hand-held, motorized depilating device for removing unwanted skin hair, introducing a new method to shorten the closure distance of the hair-traps without increasing the energy expenditure, the noise level, the vibrations, and the resulting level of discomfort encountered in using the device.

In accordance with a preferred embodiment of the present invention, there is provided a motor-powered depilating device comprising:

a hair-plucking assembly, coupled to motor means, and being exposed through an opening in a manually-held housing, said hair-plucking assembly being rotatable about a shaft and including at least two disc-like assemblies, each disc-like assembly comprising:

a central hub;

at least one radially-extending swivel support formed thereon;

at least one radially-extending swivel element mounted in spring-biased fashion on a pin radially extending from said hub, through said radially-extending swivel support, thereby defining a swiveling axis, an outer end of said swivel element defining a flattened peripheral portion substantially perpendicular to said swiveling axis, said flattened peripheral portion forming a first hair trap edge, and a pinch plate extending radially outwardly from said hub, circumferentially offset from said flattened peripheral portion and being disposed opposite a flattened peripheral portion defining a first hair trap edge associated with an adjacent disc-like assembly, said pinch plate providing a second hair trap edge, which together with said associated first hair trap edge, defines a V-shaped hair trap, and a motion control means arranged to provide closing and opening motion of said V-shaped hair trap by forcing said associated first hair trap edge against said second hair trap edge during rotational motion of said disc-like assemblies about said shaft.

In the preferred embodiment, the hair plucking assembly comprises at least two hubs, each accommodating at least one radially-extending swivel support. At least one radially-extending swivel element is mounted in spring-biased fashion on a pin radially extending from a hub. The sidewall of the hub further includes a pinch plate, which projects radially outwardly therefrom. A radially extending swivel element associated with a disc-like assembly is spring-biased to a certain position and arranged so as to define a V-shaped hair trap, with a pinch plate associated with an adjacent disc-like assembly. The other side of said pinch plate forms a second V-shaped hair trap with a radially-extending swivel element of another opposing neighboring disc-like assembly.

in the inventive device, the opposing edges of the hair-trap elements do not remain parallel to one another, during the entire period of hair-trap opening and closing. With respect to the direction of rotation of the disc-like assembly, opposing edges at the rear end are closed first, leaving the hair-trap entrance open, and only afterwards is the entire trap closed.

The inventive device provides three outstanding advantages:

1. The rotational closure distance, traveled by the hair-trap elements from the instant the trap begins to close until full trap closure, is substantially less than the rotational closure distance traveled when utilizing parallel-positioned opposing edges of hair-trap tweezer elements.
2. Since opposing edges at the rear end meet first, that end of the trap is essentially closed. This effectively delays the escape of hairs that have already entered the trap. The trap closing displacement required for closure is shortened and more hairs are trapped and the plucking efficiency increased.
3. The shortened trap closing displacement reduces the noise and vibration level associated with the device operation, and consequently, yields a reduced level of energy expenditure.

To activate the traps in the manner described above, requires that opposing radially extending swivel elements swivel on an axis substantially perpendicular to peripheral portion alignment. In addition, the opposing edges must approach the state of closure with one set of ends biased adjacent to the trap face, i.e. the line of trap closure. This is accomplished by utilizing a biasing spring or other biasing arrangement, as will be described further herein.

According to the preferred embodiment, in accordance with the principles of the present invention, the hubs are rotatably mounted on a fixed arcuate shaft and each hub includes engagement means for engaging at least one adjacent hub so that rotational motion of one hub imparts rotational motion to an adjacent hub. Trap opening and closing is accomplished by using a motion control means employing inclined pressure bearings.

According to another embodiment, the hubs are rotatably mounted on a straight shaft, and trap opening and closing is accomplished by using a motion control means employing cams or inclined thrust bearings.

Other features and advantages of the invention will become apparent from the drawings and the description contained herein below.

BRIEF DESCRIPTION OF THE DRAWINGS

For a better understanding of the invention, reference is made to the accompanying drawings, in which like numbers designate corresponding elements or sections throughout, and in which.

DETAILED DESCRIPTION OF THE PREFERRED EMBODIMENTS

Figure 1:
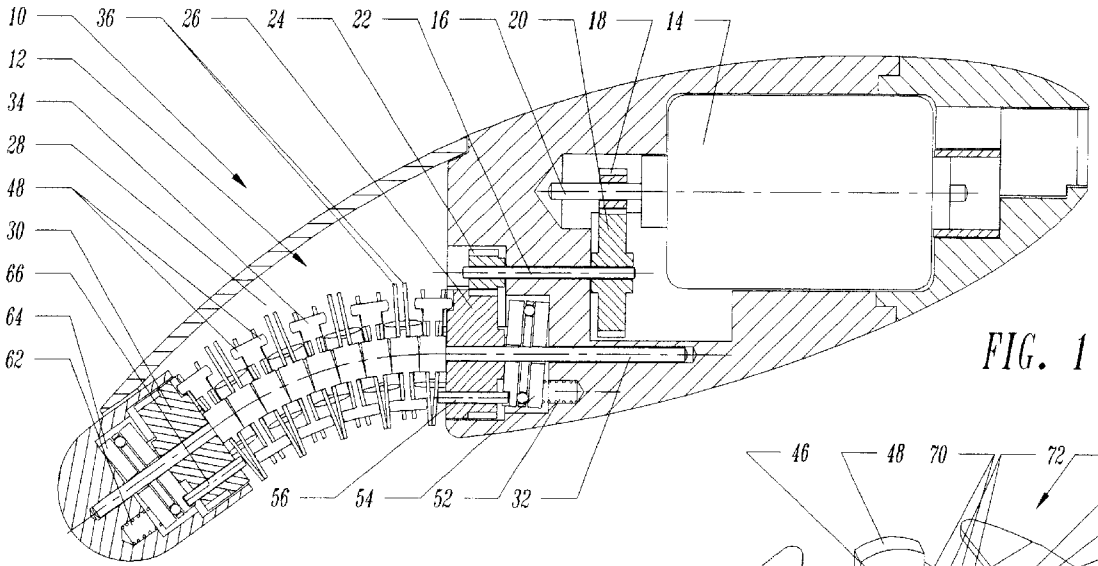
FIG. 1 is a side cross-sectional view of a prior art depilating device as shown and described in U.S. Pat. No. 5,281,233 to Dolev, featuring a number of disc assemblies.
Figure 3:
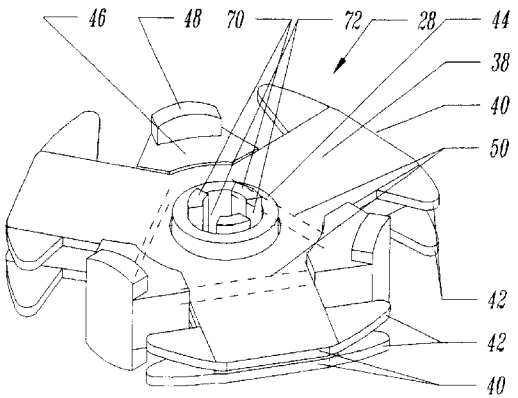
FIG. 3 is a perspective view of the disc assembly of FIG. 2.
Figure 2:
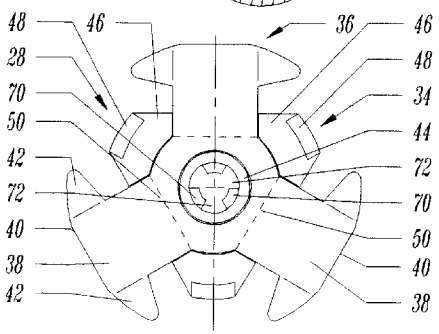
FIG. 2 is a plan view of a disc assembly used in the device of FIG. 1.

FIGS. 1–3 are reproduced from U.S. Pat. No. 5,281,233 to Dolev, inventor of the present invention. The figures are thoroughly described therein, with regard to the reference numbers shown. Therefore, the following description relates only to the specific features of interest for which a description is required in order to compare the previous and present inventions.

FIG. 1 shows a cross-sectional view of the prior art device, featuring a number of disc assemblies. The hair plucking assembly 12 is shown, comprising one or more disc assemblies 28. Each of disc assemblies 28 is rotatably mounted on an arcuate shaft 32. The curved portion of arcuate shaft 32 has a constant radius of curvature, such that disc assemblies 28 are caused with the assistance of inclined thrust bearings 54 and 64 and push rods 56 and 66 to efficiently and smoothly close and open hair-traps.

FIG. 2 is a plan view of a disc assembly used in the device of FIG. 1. Disc assembly 28 is comprised of three major parts: a hub 34, and a pair of discs 36. Each of discs 36 has at least one radially extending arm 38, emanating from its center. Each arm 38 terminates in a flattened peripheral portion 40. When flattened peripheral portion 40 is pressed against the corresponding flattened peripheral portion 40 of the complementary disc 36 a trap is formed. The central portion of each disc 36 has an opening, which is sized and shaped to fit over a projection of hub 34. Hub 34 has shoulders 46, one shoulder 46 per arm 38 of disc 36. Shoulders 46 are sized and shaped so that the leading edge of each arm 38 abuts against a portion of one of shoulders 46. A rotational motion of hub 34 transmits the same rotational motion to discs 36. Hub 34 includes a series of axial engagement protrusions 70 and recessions 72, for engaging corresponding portions in the adjacent hub, to insure that the disc assemblies interact properly.

As seen in FIG. 3, extending from shoulders 46 of hub 34 is a pair of axial protrusions 48, extending axially in opposite directions. When a particular set of axial protrusions 48 is located in the concave configuration produced by the curvature of arcuate shaft 32, axial protrusions 48 extend through the open spaces between adjacent arms 38 of discs 36 to touch the nearer disc 36 of an adjoining disc assembly 28, thereby causing the adjoining disc assembly 28 to form a trap. (see FIG. 1). Hub 34 includes an edge 50, which lies between each pair of corresponding arms 38 of complementary discs 36.

Whenever axial protrusions 48 of adjoining disc assemblies 28 press discs 36 together, a pair of arms 38 of complementary discs 36 pivot slightly towards each other about the corresponding edge 50 of hub 34 located between the pair of arms 38. This pivoting brings the pair of flattened peripheral portions 40 at the end of the pair of arms 38 together in parallel fashion to form a trap.

Figure 4:
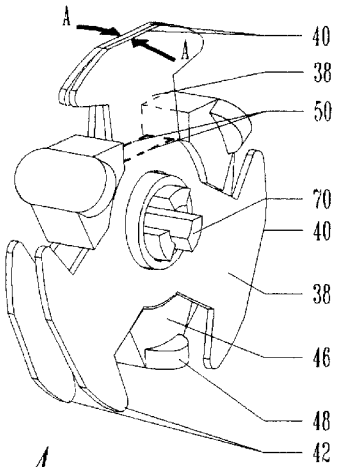
FIG. 4 shows the disc assembly of FIG. 2, as rotatably mounted on a fixed arcuate shaft.

FIG. 4 shows the disc assembly of FIG. 2, as rotatably mounted on a fixed arcuate shaft. As shown by the directional arrows A in the diagram, the radially extending arms 38 pivot about an axis oriented parallel to the peripheral portions 40 of the hair trap.

Figure 5:
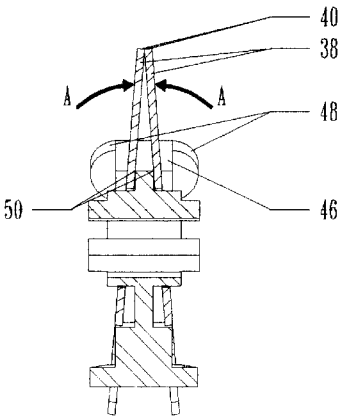
FIG. 5 displays an edge view of the disc assembly of FIG. 4.

FIG. 5 displays a sectional view of the disc assembly of FIG. 4.

Figure 6:
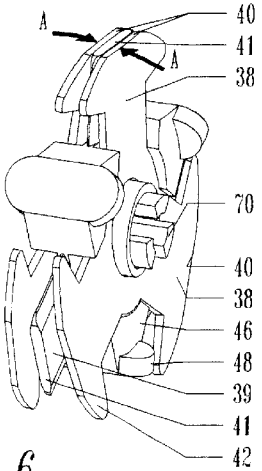
FIG. 6 is a perspective view of the disc assembly of FIG. 4, featuring a pinch plate feature, which doubles the number of hair-traps.

FIG. 6 is a perspective view of a disc assembly, incorporating the pinch plate feature, as described in the above-referenced Dolev patent (U.S. Pat. No. 5,281,233), at col. 7, lines 27–42. The edge 50 of hub 34 includes a pinch plate 39, which projects radially outward from edge 50, and which doubles the number of hair-traps.

Figure 7:
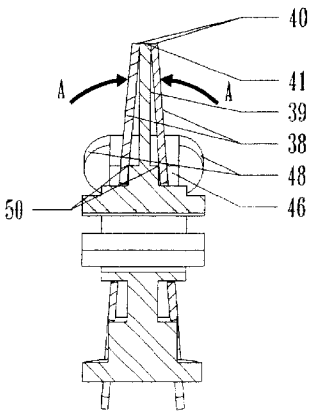
FIG. 7 displays an edge view of the disc assembly of FIG. 6.

FIG. 7 displays a sectional view of the apparatus of FIG. 6. The pivoting or bending of arms 38 of discs 36 towards each other effects the creation of two traps. One trap is formed between one face of the pinch plate 39 and one of flattened peripheral portions 40 and the other trap is formed between the other face of the pinch plate 39 and the flattened peripheral portion 40 of the complementary disc 36.

Figure 8:
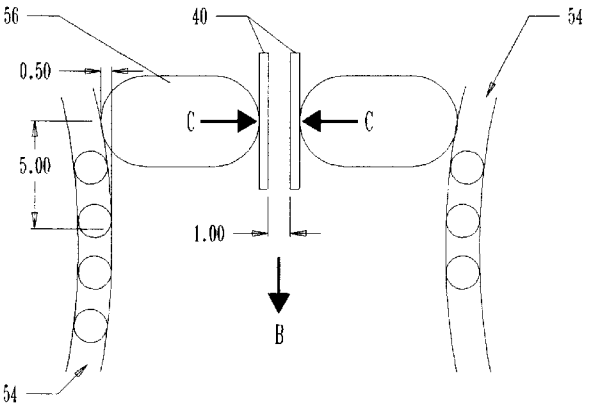
FIG. 8 schematically illustrates a prior art depilating device employing inclined thrust bearings, in which the opposing edges of the hair-trap remain parallel to one another, during the entire period of hair-trap opening and closing.

FIG. 8 schematically illustrates a prior art device, in which the opposing edges of the trap, i.e. flattened peripheral portions 40, remain parallel to one another, during the entire period of hair-trap opening and closing. Arrow B designates the direction of rotation, and arrows C designate the direction of hair trap displacement. Hair traps are opened and closed by employing inclined thrust bearings 54. The entrance width between the opposing edges of the trap is given as 1 mm., such that to close the trap, the trap closing displacement required for each side of the hair-trap is 0.5 mm. As can be seen, the rotational closure distance to achieve trap closure is 5.0 mm.

Figure 9:
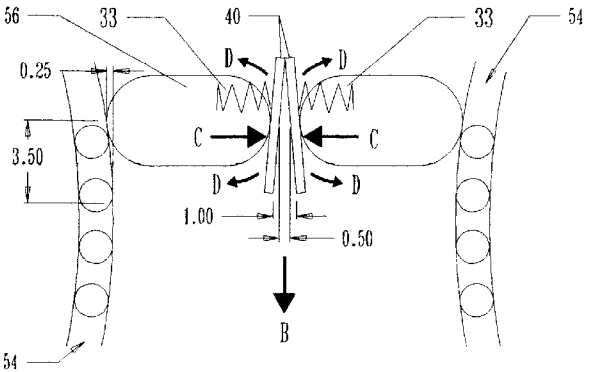
FIG. 9 schematically illustrates a preferred embodiment of a depilating device employing inclined thrust bearings, constructed and operated in accordance with the principles of the present invention, in which the opposing edges of the hair-trap are V-shaped, i.e. not parallel to one another, during the entire period of hair-trap opening and closing.

FIG. 9 schematically illustrates a preferred embodiment of a depilating device constructed and operated, in accordance with the principles of the present invention, in which the opposing edges of the hair-trap do not remain parallel to one another, during the entire period of hair-trap opening and closing. Hair traps are opened and closed by employing inclined thrust bearings. With respect to the direction of rotation of the disc-like assembly (arrow B), the rear set of ends of opposing edges meet first, and only afterwards is the entire trap closed. Although the entrance width between the opposing edges of the trap remains 1.0 mm, in order to close the trap, the trap closing displacement required for each side of the hair-trap is only 0.25 mm.

As can be seen from a comparison of FIGS. 8 and 9, the rotational closure distance has been reduced from 5 mm in the prior art design, to 3.5 mm in the present invention.

Figure 10:
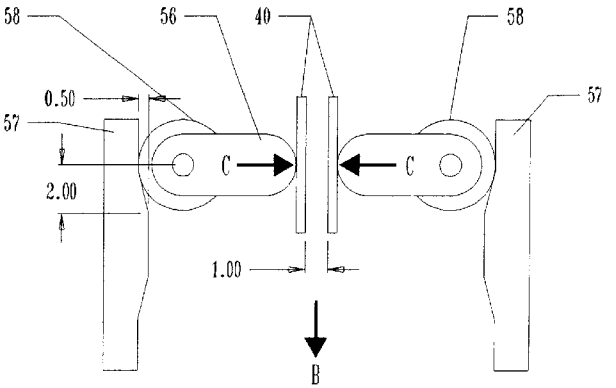
FIG. 10 schematically illustrates a prior art depilating device employing cams, in which the opposing edges of the hair-trap remain parallel to one another, during the entire period of hair-trap opening and closing.

FIG. 10 schematically illustrates a prior art device, in which the opposing edges of the trap, i.e. flattened peripheral portions 40, remain parallel to one another, during the entire period of hair-trap opening and closing. Hair traps are opened and closed by employing cams 57 and cam follower 58. The entrance width between the opposing edges of the trap is given as 1 mm., and the closing displacement required to close the trap is 0.5 mm. for each side of the hair-trap.

Figure 11:
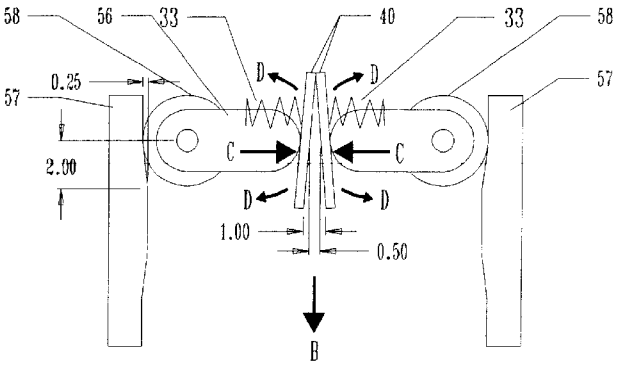
FIG. 11 schematically illustrates an alternative embodiment of a depilating device of the present invention, employing cams, in which the opposing edges are V-shaped, i.e. not parallel to one another, during the entire period of hair-trap opening and closing.

FIG. 11 schematically illustrates an alternative embodiment of a depilating device of the present invention, in which the opposing edges do not remain parallel to one another, during the entire period of hair-trap opening and closing. Hair traps are opened and closed by employing cams. The rear set of ends of opposing edges meet first and only afterwards is the entire trap closed. Although the entrance width between the opposing edges of the trap remains 1.0 mm, in order to close the trap, the trap closing displacement required for each side of the hair-trap is only 0.25 mm.

Figure 12:
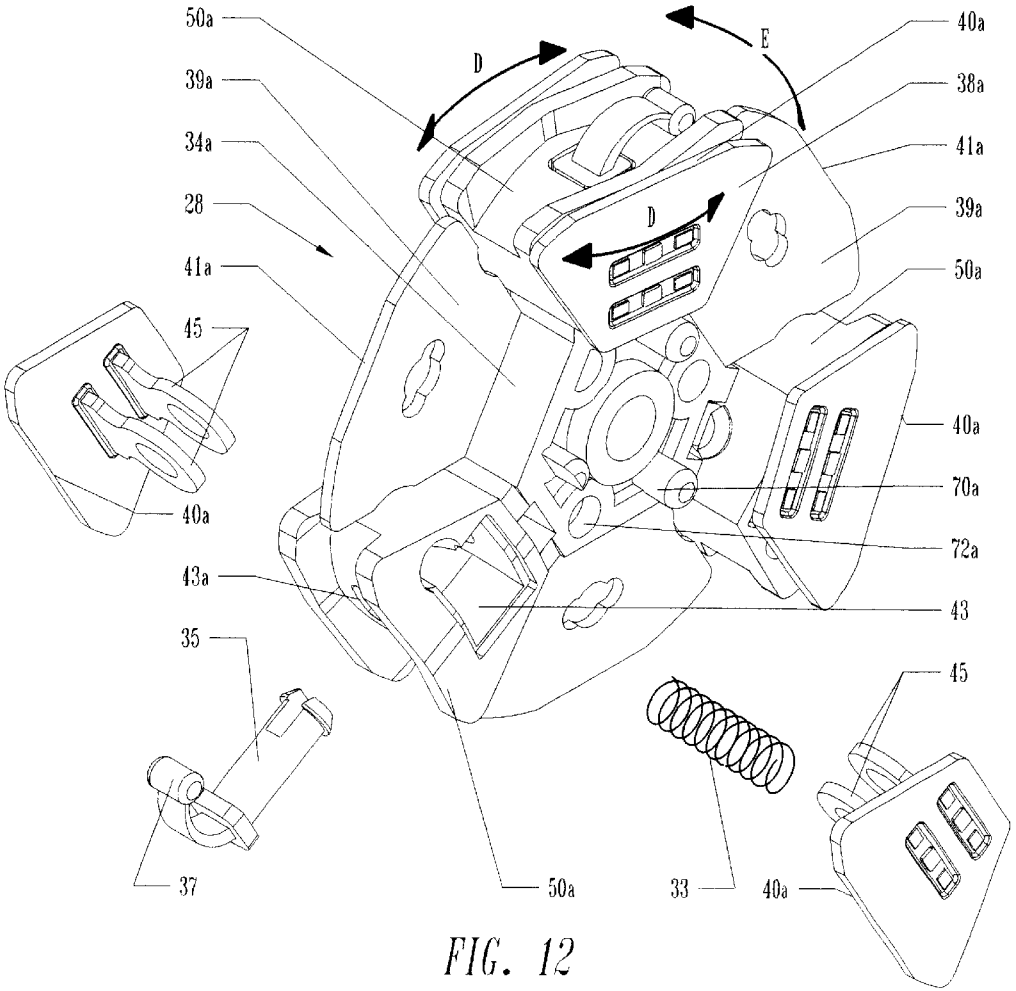
FIG. 12 is an exploded perspective view of the preferred embodiment of a depilating device disc-like assembly of the present invention, featuring radially-extending swivel elements and a biasing spring.

FIG. 12 is an exploded perspective view of an embodiment of a depilating device disc-like assembly of the present invention, featuring radially-extending swivel elements 38*a*. A disc-like assembly 28*a* comprises a central hub 34*a* having formed thereon a set of three radially-extending swivel supports 50*a*. In each of swivel element supports 50*a*, there is formed at least one cavity 43. At least one radially extending element 38*a* has formed on its inside surface a pair of lugs 45 through which pin 35 passes. Pin 35 is connected pivotally to radially-extending swivel supports 50*a* via aperture 43*a*. An outer end of the radially extending element 38*a* defines a flattened peripheral portion 40*a*. Radially-extending swivel element 38*a* is mounted in spring-biased fashion on pin 35, which defines a swiveling axis. In this embodiment, the spring biasing force (arrow E) is provided by compression spring 33, which is seated in cavity 43. Radially extending element 38*a* swivels about pin 35, as shown by rotational arrows D.

As seen in FIG. 12, the sidewall of the hub 34*a* has a pinch plate 39*a* extending radially outwardly therefrom, and circumferentially offset from the flattened peripheral portion 40*a*.

Hub 34*a* includes a series of axial engagement protrusions 70*a* and recessions 72*a*, for engaging corresponding portions in the adjacent hub, to insure that the disc-like assemblies interact properly.

Figure 13:
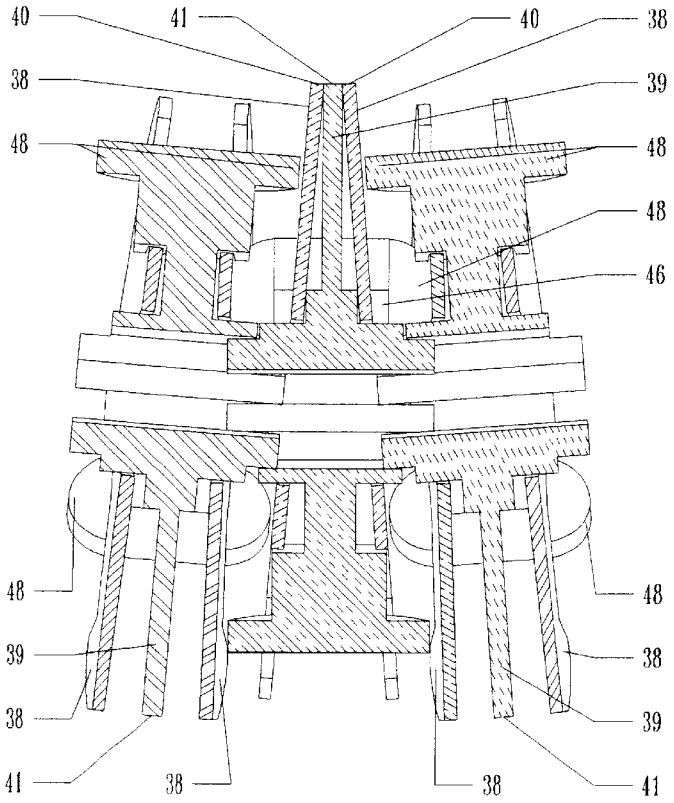
FIG. 13 is a sectional view of several adjacent prior art disc assemblies, incorporating the pinch plate feature, as shown in FIGS. 6–7.

FIG. 13 is a sectional view of several adjacent disc assemblies, incorporating the pinch plate feature, as specifically mentioned in U.S. Pat. No. 5,281,233 to Dolev. In this prior art design, each disc assembly is able to form traps by utilizing its own flattened peripheral portion 40 components. Trap closing activation force is transmitted between adjacent discs by axial protrusions 48 as shown in FIGS. 6, 7.

Figure 14:
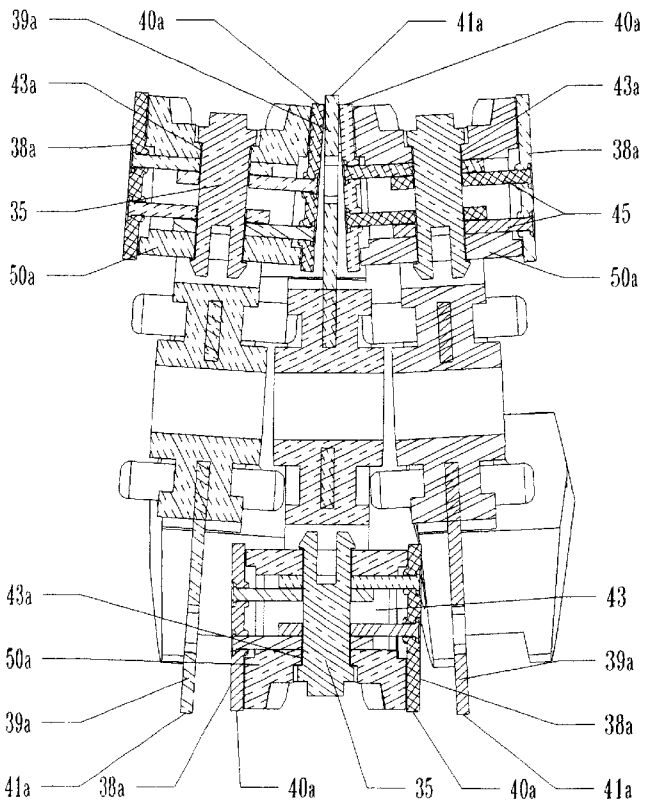
FIG. 14 is a sectional view of the preferred embodiment of the present invention featuring several adjacent disc-like assemblies, incorporating the pinch plate feature and the swivel elements.

FIG. 14 is a sectional view of several adjacent disc-like assemblies, incorporating the pinch plate feature and the radially extending swivel arms, constructed and operated, in accordance with the principles of the present invention. In the present invention, two disc-like assemblies are required to form a trap between pinch plate 39*a* and a flattened peripheral portion 40*a*.

Figure 15:
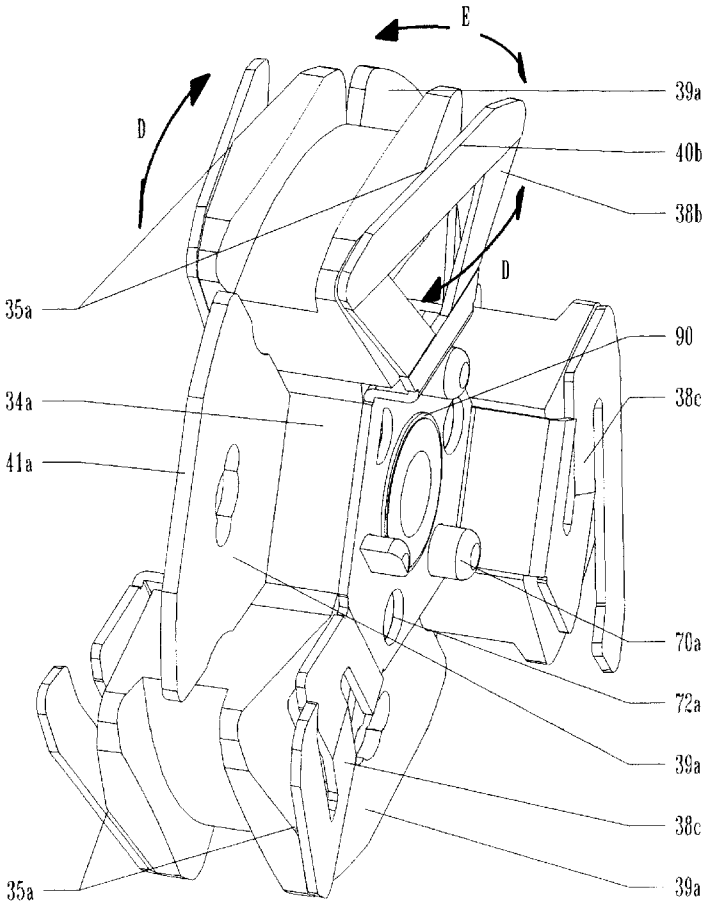
FIG. 15 is a perspective view of an alternative embodiment of a depilating device disc-like assembly of the present invention, featuring alternative types of spring-like swivel members.

FIG. 15 is a perspective view of an alternative embodiment of a depilating device disc-like assembly of the present invention, featuring alternative types of spring-like swivel members 38*b* and 38*c* acting as radially extending swivel elements. Whereas in FIG. 12, it can be clearly seen that the two radially-extending swivel elements share a common swiveling axis, in FIG. 15 each radially-extending swivel element has its own virtual swiveling axis 35*a*, that is still substantially perpendicular to the flattened peripheral portions 40*a*. The swivel elements and biasing spring employed in FIG. 12 have been replaced by spring-like members 38*b,c*. The spring-like swivel members 38*b,c* are fixed to the hub by ultrasonic welding or other method, thus ensuring consistent springiness.

Figure 16:
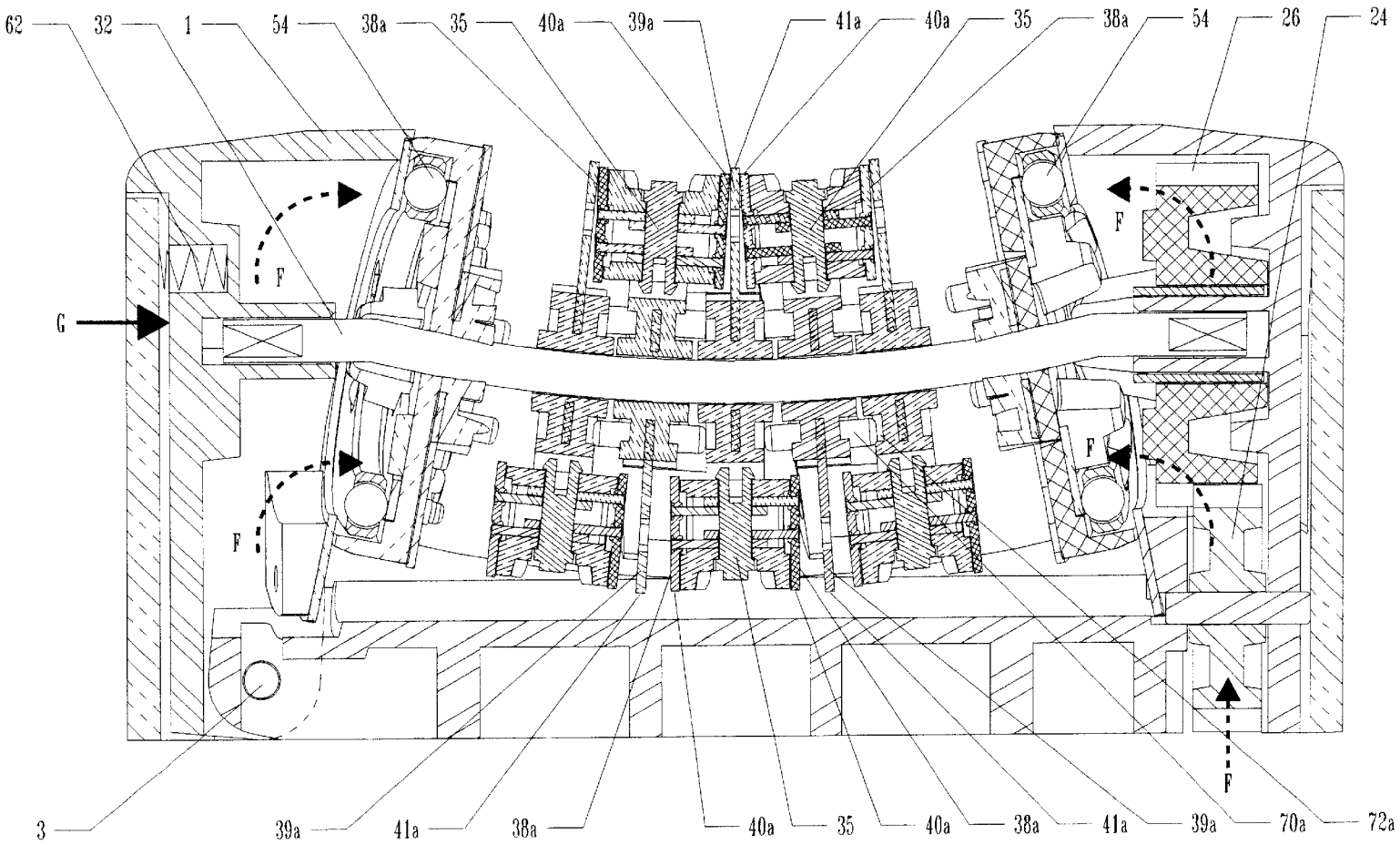
FIG. 16 is a side cross-sectional view of the preferred embodiment of the present invention, featuring a number of disc-like assemblies.

FIG. 16 is a side cross-sectional view of an embodiment, constructed and operated in accordance with the principles of the present invention, featuring a number of disc-like assemblies. Pinch plate 39*a* is shown disposed between a pair of flattened peripheral portions 40*a* associated with adjacent disc assemblies, so as to define a pair of V-shaped hair traps, one on each side of the pinch plate.

Spring 62 transmits trap-closing force (arrow G) via inclined thrust bearing 54 to the total hair plucking assembly. Arrows F show the flow of air through the depilating device, which is provided to create a positive pressure, as described further herein with respect to FIG. 18.

Figure 17:
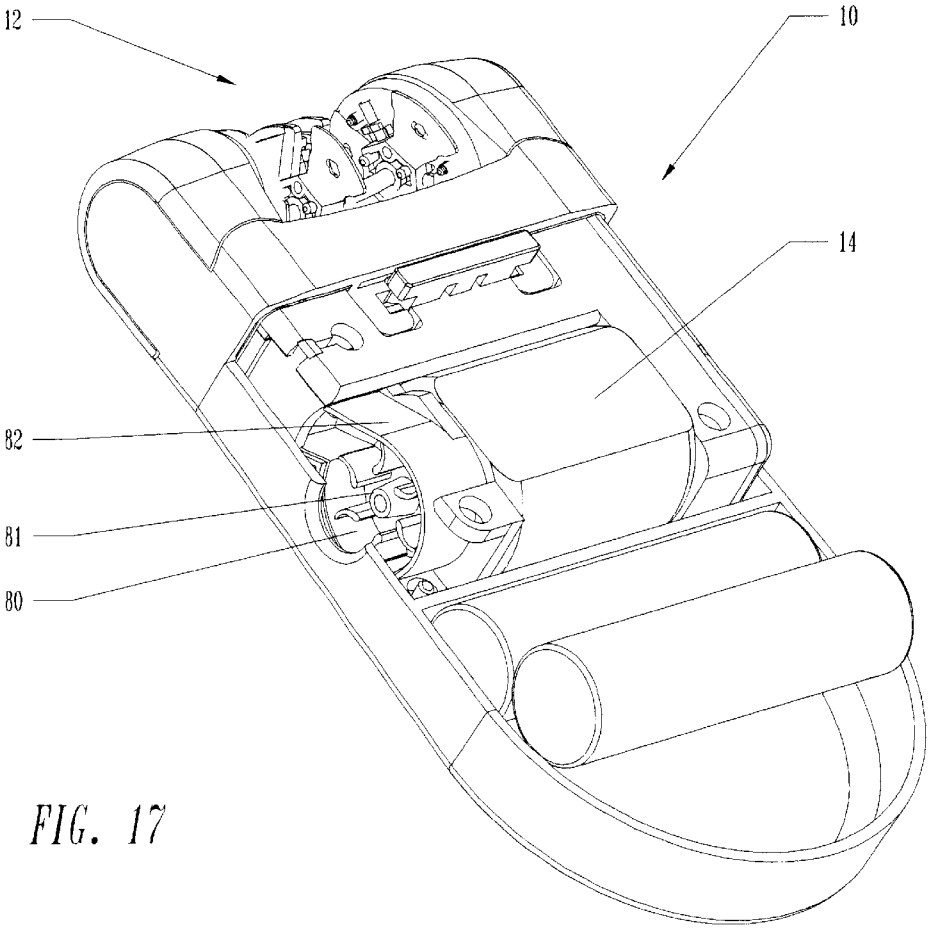
FIG. 17 is an isometric view of the preferred embodiment of the present invention, showing the electrical motor and air compressor.

FIG. 17 is a perspective view of the preferred embodiment of the device, showing a miniature air compressor 80 mechanism, including a shroud 82 and impeller 81.

Figure 18:
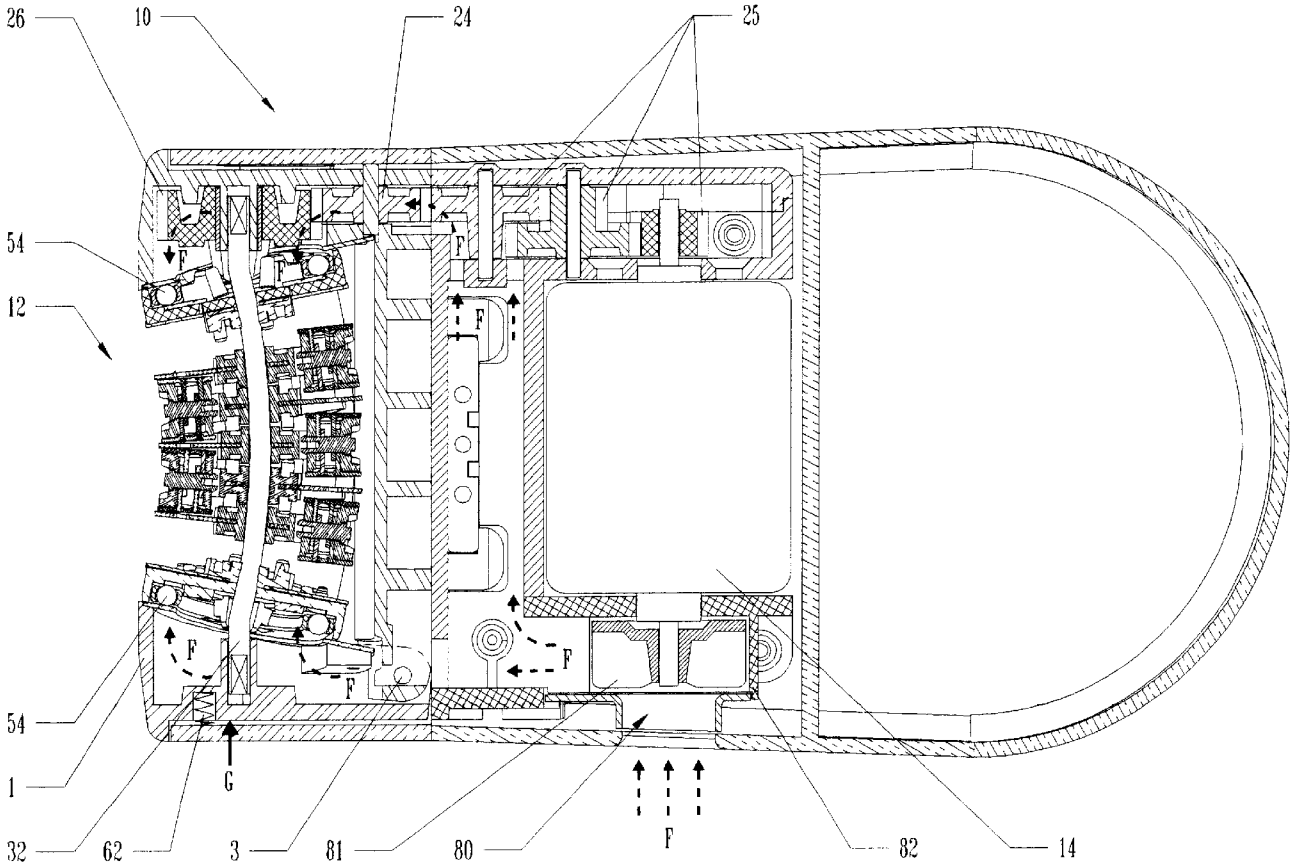
FIG. 18 is a cross sectional view of the device of FIG. 17.

FIG. 18 is a cross-sectional view of the device of FIG. 17, in which the miniature air compressor 80 is shown. The dotted arrows F indicate the airflow in the device, and this airflow is developed when depilating device motor 14 is activated. This airflow setup creates a positive pressure to prevent small hairs from clogging the sensitive internal mechanisms and pressure bearings.

Figure 19:
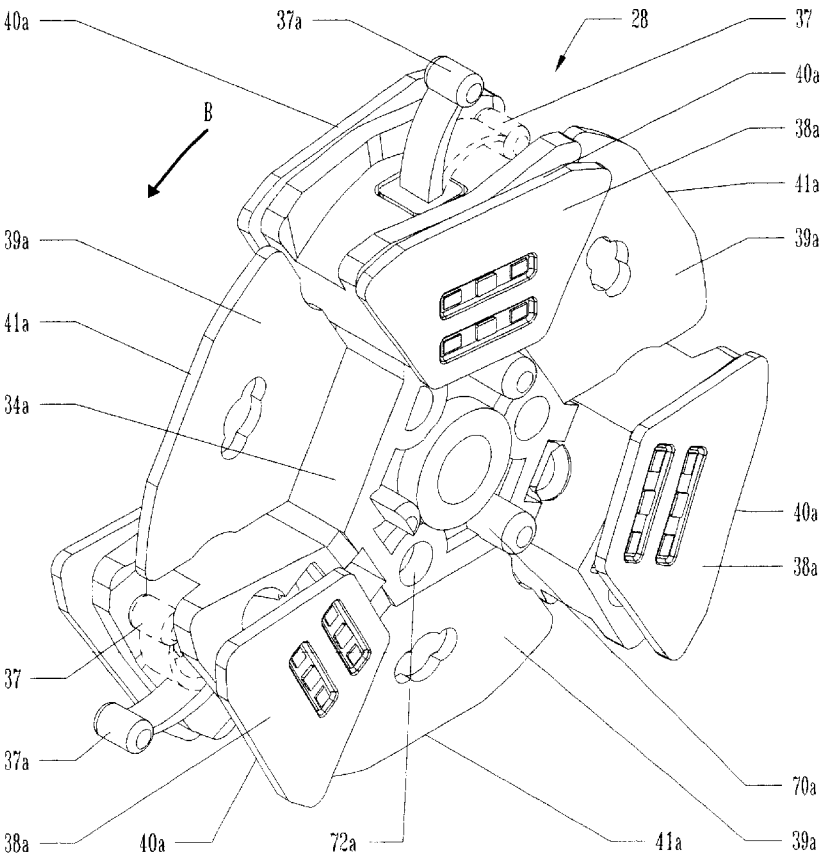
FIG. 19 is a perspective view of the preferred embodiment of the present invention, featuring a pain reducing attachment, mounted on each radially extending swivel support.

FIG. 19 is a perspective view of the preferred embodiment of the present invention, featuring soft whipping pain reducing attachments, mounted on each radially extending swivel support 50*a*. The direction of rotation is designated by arrow B. The pain reducing attachment 37*a* is shown in two positions: before rotation it is retracted (shown as 37) and once the rotation starts it is extracted (shown as 37*a*) beyond the periphery of the disc-like assembly by centrifugal force. In this embodiment, pain reducing attachment 37*a* is made of soft plastic and mounted on the top portion of pin 35, and contacts the skin before the trap edges do. This prior contact desensitizes the skin to an appreciable degree and thereby reduces the pain level experienced. In other embodiments, the pain reducing attachment 37*a* may be mounted in other locations on the periphery of the radially extending swivel support 50*a*.

Figure 20:
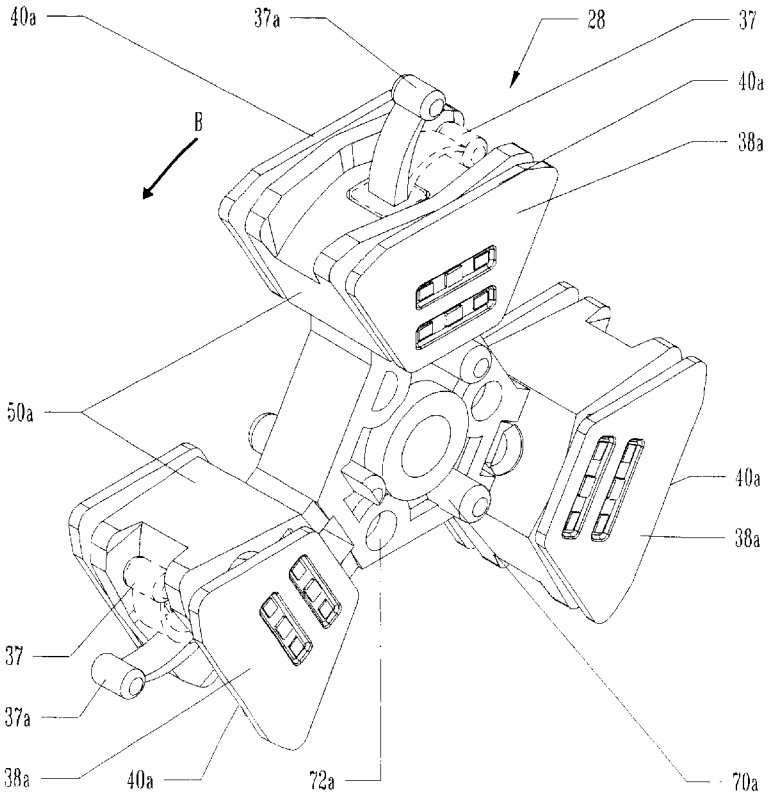
FIG. 20 is a perspective view of an alternative embodiment of the present invention, featuring a pain reducing attachment, mounted on each radially extending swivel support, but not incorporating the pinch plate feature.

FIG. 20 is a perspective view of an alternative embodiment of the present invention, not incorporating the pinch plate feature, featuring a pain reducing attachment, mounted on each radially extending swivel support 50*a*. The direction of rotation is designated by arrow B. The pain reducing attachment 37*a* is shown in two positions: before rotation it is retracted (shown as 37) and once the rotation starts it is extracted (shown as 37*a*) beyond the periphery of the disc-like assembly by centrifugal force. In this embodiment, pain reducing attachment 37*a* is made of soft plastic and mounted on the top portion of pin 35, and contacts the skin before the trap edges do. This prior contact desensitizes the skin to an appreciable degree and thereby reduces the pain level experienced. In other embodiments, the pain reducing attachment 37*a* may be mounted in other locations on the periphery of the radially extending swivel support 50*a*.

Figure 21:
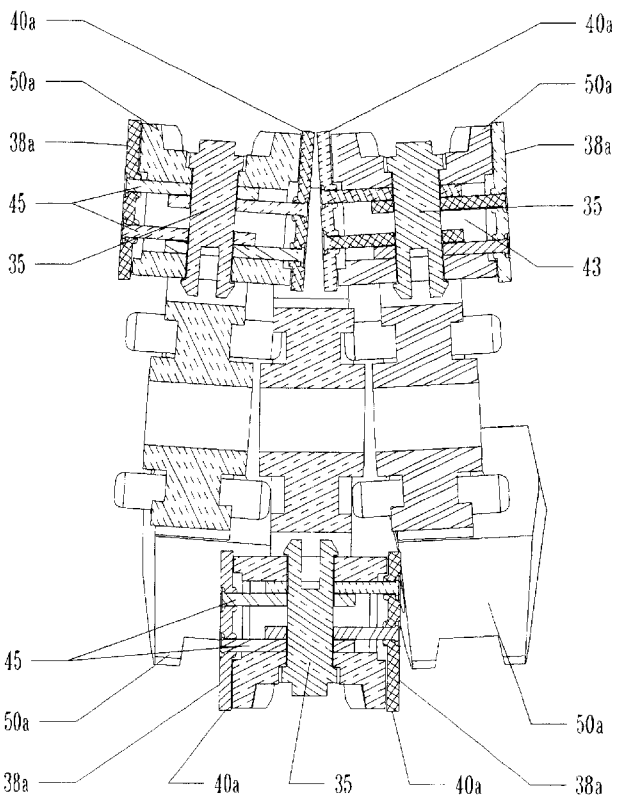
FIG. 21 is a sectional view of an alternative embodiment of the present invention featuring several adjacent disc-like assemblies, incorporating the swivel elements, but not the pinch plate feature.

FIG. 21 is a sectional view of several adjacent disc-like assemblies, incorporating the radially extending swivel arms, constructed and operated, in accordance with the principles of the present invention. In the present invention, two disc-like assemblies are required to form a trap with pinch plate 39*a*. In this embodiment, the pinch plate feature is not incorporated.

Having described the invention with regard to a certain specific embodiment, it is to be understood that the description is not meant as a limitation since further modifications may now suggest themselves to those skilled in the art, and it is intended to cover such modifications, as fall within the scope of the appended claims.

I claim:

1. A motor-powered depilating device comprising:

a hair-plucking assembly, coupled to motor means, and being exposed through an opening in a manually-held housing, said hair-plucking assembly being rotatable about a shaft and including at least two disc-like assemblies, each disc-like assembly comprising:

a central hub;

at least one radially-extending swivel support formed thereon;

at least one radially-extending swivel element is mounted in spring-biased fashion on a pin radially extending from said hub, through said radially-extending swivel support, thereby defining a swiveling axis, an outer end of said swivel element defining a flattened peripheral portion substantially perpendicular to said swiveling axis, said flattened peripheral portion forming a first hair trap edge, and a pinch plate extending radially outwardly from said hub, circumferentially offset from said flattened peripheral portion and being disposed opposite a flattened peripheral portion defining a first hair trap edge associated with an adjacent disc-like assembly, said pinch plate providing a second hair trap edge, which together with said associated first hair trap edge, defines a V-shaped hair trap, said radially extending swivel element associated with said disc-like assembly being spring-biased to a certain position, such that said first hair trap edge meets said second hair trap edge first at the rear end, and a motion control means arranged to provide closing and opening motion of said V-shaped hair trap by forcing said associated first hair trap edge against said second hair trap edge during rotational motion of said disc-like assemblies about said shaft, thereby closing said V-shaped hair trap, initially at its rear end, and only afterwards closing said entire trap, thereby reducing a trap closing displacement applied to said first and second hair trap edges, and reducing a rotational closure distance for achieving trap closure.

2. The device of claim 1, wherein said radially-extending swivel elements and said biasing spring are replaced by spring-like members fixed to said hub, thus ensuring consistent springiness to said V-shaped hair traps.

3. The device of claim 1, further comprising a miniature air compressor providing an air-flow through the depilating device, said air-flow creating a positive internal pressure that prevents small hairs from clogging internal mechanisms of said depilating device.

4. The device of claim 3, wherein said air compressor is activated by said motor means.

5. The device of claim 3, wherein said compressor is activated by a motor independent of said motor means.

6. The device of claim 1, further comprising a soft whipping pain reducing attachment, mounted on at least one of said swivel element supports, said pain reducing attachment being extracted beyond said disc-like assembly periphery, by centrifugal force generated once said depilating device operation begins, said pain reducing attachment slightly flicking the skin before said trap edges touch the skin, thereby desensitizing the skin to an appreciable degree and reducing the pain level experienced.

7. A motor-powered depilating device comprising:

a hair-plucking assembly, coupled to motor means, and being exposed through an opening in a manually-held housing, said hair-plucking assembly being rotatable about a shaft and including hair traps, a motion control means arranged to provide closing and opening motion of said hair traps by forcing edges of said hair trap against one another during rotational motion of said hair plucking assembly about said shaft, and a miniature air compressor providing an air-flow through the depilating device, said air-flow creating a positive internal pressure that prevents small hairs from clogging internal mechanisms of the depilating device.

8. A motor-powered depilating device comprising:

a hair-plucking assembly, coupled to motor means, and being exposed through an opening in a manually-held housing, said hair-plucking assembly being rotatable about a shaft and including hair traps, a motion control means arranged to provide closing and opening motion of said hair traps by forcing edges of said hair trap against one another during rotational motion of said hair plucking assembly about said shaft, and a soft whipping pain reducing attachment, mounted on said hair-plucking assembly, said pain reducing attachment being extracted beyond said hair-plucking assembly periphery, by centrifugal force generated once said depilating device operation begins, said pain reducing attachment slightly flicking the skin before said trap edges touch the skin, thereby desensitizing the skin to an appreciable degree and reducing the pain level experienced.

9. The device of claim 8, said pain reducing attachment being extracted beyond said hair-plucking assembly periphery continuously.

10. A motor-powered depilating device comprising:

a hair-plucking assembly, coupled to motor means, and being exposed through an opening in a manually-held housing, said hair-plucking assembly being rotatable about a shaft and including at least two disc-like assemblies, each disc-like assembly comprising:

a central hub;

at least one radially-extending swivel support formed thereon;

at least one radially-extending swivel element mounted in spring-biased fashion on a pin radially extending from said hub, through said radially-extending swivel support, thereby defining a swiveling axis, an outer end of said swivel element defining a first flattened peripheral portion substantially perpendicular to said swiveling axis, said first flattened peripheral portion forming a first hair trap edge, and a second flattened peripheral portion associated with an adjacent disc-like assembly being disposed opposite said first flattened peripheral portion, said second flattened peripheral portion providing a second hair trap edge, which together with said first hair trap edge, defines a V-shaped hair trap, said radially extending swivel element associated with said disc-like assembly being spring-biased to a certain position, such that said first hair trap edge meets said second hair trap edge first at the rear end, and a motion control means arranged to provide closing and opening motion of said V-shaped hair trap by forcing said first hair trap edge against said second hair trap edge during rotational motion of said disc-like assemblies about said shaft, thereby closing said V-shaped hair trap, initially at its rear end, and only afterwards closing said entire trap, thereby reducing a trap closing displacement applied to said first and second hair trap edges, and reducing a rotational closure distance for achieving trap closure.

* * * * *